US010787942B2

(12) United States Patent
Bock et al.

(10) Patent No.: US 10,787,942 B2
(45) Date of Patent: Sep. 29, 2020

(54) VALVE COMPONENT FOR REGULATING OR CONTROLLING A FLUID PRESSURE

(71) Applicant: MANN+HUMMEL GmbH, Ludwigsburg (DE)

(72) Inventors: Lukas Bock, Bietigheim-Bissingen (DE); Juergen Tilg, Ittlingen (DE)

(73) Assignee: MANN+HUMMEL GmbH, Ludwigsburg (DE)

( * ) Notice: Subject to any disclaimer, the term of this patent is extended or adjusted under 35 U.S.C. 154(b) by 0 days.

(21) Appl. No.: 16/165,644

(22) Filed: Oct. 19, 2018

(65) Prior Publication Data

US 2019/0120099 A1 Apr. 25, 2019

(30) Foreign Application Priority Data

Oct. 20, 2017 (DE) ..... 10 2017 009 790

(51) Int. Cl.
*F01M 13/00* (2006.01)
*F02F 1/24* (2006.01)

(52) U.S. Cl.
CPC ..... *F01M 13/0011* (2013.01); *F02F 1/24* (2013.01); *F01M 2013/0016* (2013.01)

(58) Field of Classification Search
CPC ..... F01M 13/0011; F01M 2013/0016; F02F 1/24
See application file for complete search history.

(56) References Cited

U.S. PATENT DOCUMENTS 6,802,303 B2 * 10/2004 Hakansson ..... F01M 13/022 123/574
2004/0035403 A1 * 2/2004 Pateman ..... F01M 13/0416 123/574
2011/0174397 A1 * 7/2011 Goerlich ..... F01M 13/0011 137/535

FOREIGN PATENT DOCUMENTS

| | | | |
|---|---|---|---|
| CN | 101672381 | A | 3/2010 |
| DE | 3326881 | A1 | 5/1984 |
| DE | 10143686 | A1 | 3/2003 |
| DE | 10321211 | A1 | 12/2004 |
| DE | 202004003860 | U1 | 7/2005 |
| DE | 102011050617 | A1 | 12/2012 |
| DE | 102014108529 | A1 | 12/2015 |
| DE | 102015005692 | A1 | 11/2016 |
| EP | 2216519 | A2 | 8/2010 |
| JP | H10196814 | A | 7/1998 |

* cited by examiner

*Primary Examiner* — Jacob M Amick
(74) *Attorney, Agent, or Firm* — James Hasselbeck

(57) ABSTRACT

A valve component is provided with a unit for regulating or controlling a fluid pressure and is further provided with an expansion chamber. The unit has a valve housing with a first housing part and a second housing part, between which a switching element is arranged. The first housing part has an inlet and an outlet for a fluid. The switching element is arranged between the inlet and the outlet for regulating, releasing or shutting of a flow of the fluid. The switching element separates two chambers in the valve housing from each other. In open switching position of the switching element, the inlet and the outlet are connected by one of the chambers, and at least one first venting bore opens from the other one of the chambers into the expansion chamber.

18 Claims, 2 Drawing Sheets

VALVE COMPONENT FOR REGULATING OR CONTROLLING A FLUID PRESSURE

BACKGROUND OF THE INVENTION

The invention concerns a valve component for regulating or controlling a fluid pressure, in particular for the pressure regulation of the internal combustion engine and/or of the crankcase of the internal combustion engine of a motor vehicle.

Pressure regulating valves are employed, for example, in the venting line between crankcase and the intake manifold of an internal combustion engine. In this context, the goal is to prevent the pressure or vacuum in the containers to be vented from rising beyond a predetermined value.

In internal combustion engines, blow-by gases occur that are produced in that the combustion gases in the cylinder escape past the cylinder piston into the crankcase. These blow-by gases cause the pressure in the crankcase to rise, and leakages and escape of oil may be the result. In order to avoid a pressure increase and to discharge the blow-by gases in an environmentally friendly way, the blow-by gases are returned from the crankcase into the air intake manifold of the internal combustion engine. On the other hand, the specified vacuum value should not be undershot significantly because then, due to leaks, undesirable leak air would be sucked into the crankcase.

In case of the pressure regulating valves that are currently employed, usually a switching film, known to a person of skill in the art also by the term "switching diaphragm", made of elastomer, frequently fluorosilicone rubber (FVMQ), is used. These switching films are very flexible due to the specific properties of elastomers. As a function of the applied pressure conditions, this switching film opens and closes an opening in the pressure regulating valve. The pressure ratio results usually from the pressure difference between the applied pressure in a first chamber and the existing pressure in a second chamber of the pressure regulating valve. The pressure in the first chamber can be the same as atmospheric pressure, for example. The switching film must react to minimal switching pressures in the magnitude of 1 mbar to 250 mbar. The pressure regulating valve regulates the flow by the pressure difference applied to the switching film without additional control member such as, for example, an actuator or the like.

Blow-by gases are comprised of uncombusted fuel proportions, engine oil proportions, and other contaminants produced by combustion. These gases attack many elastomer types whereby damages of the material properties may occur. The components made of these materials become brittle, porous, and cracked. When the switching films are damaged, the environmentally harmful blow-by gases directly reach the environment because the system is no longer seal-tight. The switching film of an elastomer is usually embodied as a rolling film in order to realize a specified stroke of the film.

In the known pressure regulating valves, the switching diaphragm, depending on respective operating point and employed material of the switching diaphragm, may be excited to vibrate which leads to disruptive noises that moreover may propagate into the environment through the required venting bore in the cover of the pressure regulating valve.

DE 101 43 686 A1 discloses a venting valve in which a channel projects into a venting line and is connected to a Helmholtz resonator. The Helmholtz resonator is matched to the frequency range of the noises to be suppressed and forms a $\lambda/4$ resonator. Acoustic measures in the form of Helmholtz resonators and the like require however additional components, installation space, and connecting parts.

SUMMARY OF THE INVENTION

It is an object of the invention to provide a valve component for switching at low pressure differences which exhibits a low noise development when operated at an internal combustion engine.

The aforementioned object is solved according to an aspect of the invention by a valve component that comprises a unit for regulating or controlling a fluid pressure and further comprises an expansion chamber, wherein the unit comprises a valve housing, comprising a first housing part and a second housing part, between which a switching element is arranged, wherein the first housing part comprises an inlet and an outlet for a fluid, wherein the switching element is arranged between the inlet and the outlet for regulating, releasing or shutting off a flow of the fluid, wherein the switching element separates two chambers in the housing from each other, wherein, in open switching position of the switching element, inlet and outlet are connectable by means of one of the chambers, and wherein at least a first venting bore of the other one of the chambers opens into the expansion chamber. The expansion chamber comprises the same pressure as the other chamber connected with the expansion chamber and serves for noise minimization, wherein the expansion chamber does not affect the pressure difference at the switching element.

Beneficial configurations and advantages of the invention result from the additional claims, the description, and the drawing.

A valve component is proposed that comprises a unit for regulating or controlling a fluid pressure and further comprises at least one expansion chamber, wherein the unit comprises a valve housing, comprising a first housing part and a second housing part between which a switching element is arranged, wherein the first housing part comprises an inlet and an outlet for a fluid, wherein the switching element for regulating, releasing or shutting off a flow of the fluid is arranged between the inlet and the outlet, wherein the switching element separates two chambers in the housing from each other, wherein, in open switching position of the switching element, inlet and outlet are connectable by one of chambers, and wherein at least a first venting bore opens from the other one of the chambers into the expansion chamber.

Advantageously, a valve component, for example, a pressure regulating valve, with a damper, integrated in series, can be created for an acoustic improvement of the valve component. The expansion chamber can be formed by a single hollow space or it can be divided into several chambers; the latter can comprise the same size or can be of different size. The expansion chamber can be additionally filled with a suitable acoustically effective medium, for example, with an acoustic foam or the like.

The acoustic effect of the proposed valve component is determined by the volumes of the chambers and the free cross sections of the connection between the chambers and the free cross section of the venting bore into the environment.

By integration of an expansion chamber, arranged in series, as an acoustic damper, integrated into the valve housing and/or arranged at the valve housing of the valve component, the required installation space can be reduced compared to a solution in which one or several additional components are required.

In a further advantageous embodiment, as an alternative or in addition to expansion chambers provided integrated in series, the expansion chambers can also be arranged in parallel. Also, further resonator solutions can be embodied in parallel, such as broadband dampers, Helmholtz resonators or lambda-fourth tubes ($\lambda/4$ tubes).

Different realizations of an expansion chamber are possible. They can be selected expediently depending on the respectively employed manufacturing process for the valve component. Advantageously, despite the additional expansion chamber being provided compared to a simple valve component, the additional expenditure in regard to the manufacture of the valve component can be kept minimal.

The second chamber of the valve component can be loadable with an atmospheric pressure. For an effective regulating behavior of the valve component, the switching element should be able to move as freely as possible, for which purpose the second chamber, which is separated by the switching element from the first chamber in which the fluid to be regulated is contained, is expediently in communication with the environmental region, i.e., the atmospheric pressure. A spring element engaging the switching element compensates in this context the atmospheric pressure so that the control behavior of the switching element can be realized in a low pressure difference range.

Advantageously, the switching element can be designed to be areal, in particular in the form of a switching film for switching at pressure differences of 1 mbar to 250 mbar, preferably of 1 mbar to 100 mbar. The valve component not only can release or shut off the flow, but can also regulate the flow of the fluid between the two switching states "release" or "shut-off" by a continuous change of the flow cross section as a function of the pressure difference between the inlet and the outlet of the valve component.

According to a beneficial first embodiment, the expansion chamber can be arranged at the second housing part. Preferably, the second housing part can be a housing cover. An arrangement at the second housing part is particularly beneficial when laser welding is used in manufacturing the valve housing. An integration of the expansion chamber in, or a connection with, the housing cover is advantageous because the welding process is not hindered by the housing cover.

According to a beneficial embodiment, the second housing part and a cover provided at the second housing part can enclose the expansion chamber. The cover can be connected fixedly with the second housing part, for example, welded thereto or glued thereto, or the cover can be provided with a suitable thread and screw-connected to the second housing part; a connection by means of fastening screws can be provided, or a locking connection.

According to a beneficial embodiment, the at least one first venting bore can extend from the second chamber through the second housing part into the expansion chamber at the second housing part. The configuration is beneficial when joining the first and second housing parts by means of laser welding.

According to a beneficial configuration, the valve component may comprise at least one second venting bore which is extending between the expansion chamber and an outer region of the valve component. In particular, the at least one second venting bore can extend in the second housing part and/or in the cover of the expansion chamber. It is possible to provide only one venting opening or several venting openings can be provided.

According to an alternative embodiment, the expansion chamber can be arranged in the first housing part. This arrangement is beneficial when hot plate welding is provided in the manufacturing method of the valve housing.

According to a beneficial configuration, a groove in the first housing part of the valve housing can form the expansion chamber wherein the groove is preferably arranged coaxial to the circumference of the switching element. Expediently, an already existing groove in the first housing part can be utilized, in particular a groove at the weld seam, by sufficiently enlarging it.

According to a beneficial embodiment, the at least one first venting bore can extend from the second housing part to the first housing part. The at least one venting bore can be produced in a simple way with regard to tools and positioned beneficially.

According to a beneficial embodiment, the at least one second venting bore can extend in the first housing part. Beneficially, the venting bore can extend from the groove outwardly. This can be realized beneficially with regard to installation space.

According to a beneficial embodiment, the second housing part and the first housing part can be connected by means of a locking connection. Alternatively, also other connecting techniques can be employed.

According to a beneficial embodiment, the switching element can be comprised of a fluorine and carbon comprising polymer material, in particular of fluorine and carbon comprising thermoplastic polymer material, in particular of PTFE (polytetrafluoroethylene). Preferably, the fluorine and carbon comprising polymer material can be polytetrafluoroethylene or polytetrafluoroethylene with admixtures or thermoplastically processible polytetrafluoroethylene. The fluorine and carbon comprising polymer film is chemically resistant and can switch many switching cycles of the switching element. The long-term stability of the valve component is improved. Alternatively, the switching element can be an elastomer.

Advantageously, the switching element can comprise a plate-shaped flat body with a bending region surrounding a central closure region, wherein, when switching the switching film, the bending region moves the closure region relative to a valve seat in axial direction toward the valve seat or away from the valve seat by a low-expansion, i.e., for practical application practically expansion-free, in particular expansion-free, bending movement. Since the switching element in this embodiment can bend not only within a small areal region but across a large surface area due to the plate-shape configuration, individual regions of the switching element are little loaded by expansion. The bending movement is thus carried out across a large region of the switching element and therefore with minimal elastic deformation in the form of a curvature change with minimal expansion, for example, less than 10%.

A fluorine and carbon comprising polymer material such as PTFE can be produced by a sintering process and subsequently mechanically processed. The film of such a material is very stiff in its normal shape and not suitable for flexible components. PTFE comprises an excellent chemical resistance and can be used within a very broad temperature range, wherein the modulus of elasticity toward low temperatures increases very strongly in comparison to elastomer materials. For this reason, PTFE is rather unsuitable for use as a film in the temperature range (−40° C. to +150° C.)

required in case of automotive applications at an internal combustion machine. This disadvantage for a proposed valve component can be advantageously circumvented by a special geometry and optionally by extremely thin wall thicknesses of the film of fluorine and carbon comprising polymer. By a reduction of the wall thickness of the PTFE material in a movable region to a few tenths of a millimeter, wherein the non-movable sealing region as well as the clamping region of the material can also be embodied thicker, and by a specially developed geometry of the film without rolling region, as it is employed usually in the prior art, the stiff material can be brought into a shape in which it comprises the required flexibility but still fulfills the mechanical requirements with regard to crack formation, expansion, and bending fatigue strength. Due to the special geometry, no rolling movement occurs anymore but a low-expansion bending movement with a radius change by means of which a stroke movement of the switching element for a unit can be realized.

When using such a switching element in a valve component, the proposed embodiment with expansion chamber is particularly advantageous because a propagation of a possible noise can be inhibited particularly effectively.

In this context, by means of a spring element which is supported at the valve housing, a force is exerted on the switching element in order to be able to adjust the regulating behavior of the valve component in a suitable way. The outlet of the valve housing comprises a valve seat at an end arranged in the valve housing which is closable by the closure region of the switching element so that a conduction of the fluid from the inlet to the outlet can be regulated.

Optionally, the embodiments can be combined so that both housing parts have expansion chambers.

According to a further aspect of the invention, the use of a valve component according to the invention is proposed for pressure regulation of an internal combustion engine and/or for pressure regulation of a crankcase of an internal combustion engine.

In an advantageous arrangement, a cylinder head cover of an internal combustion engine comprises a valve component according to the invention for pressure regulation of a crankcase of the internal combustion engine. The valve component according to the invention is advantageously integrated into the cylinder head cover. In a particularly advantageous embodiment, the housing of the valve component is embodied as a single piece together with the housing of the cylinder head cover, in particular as an injection molded synthetic material part, in particular of thermoplastic synthetic material.

BRIEF DESCRIPTION OF THE DRAWINGS

Further advantages result from the following drawing description. In the drawings, embodiments of the invention are illustrated. The drawings, the description, and the claims contain numerous features in combination. A person of skill in the art will expediently consider the features also individually and combine them to meaningful additional combinations.

DESCRIPTION OF PREFERRED EMBODIMENTS

Figure 1:
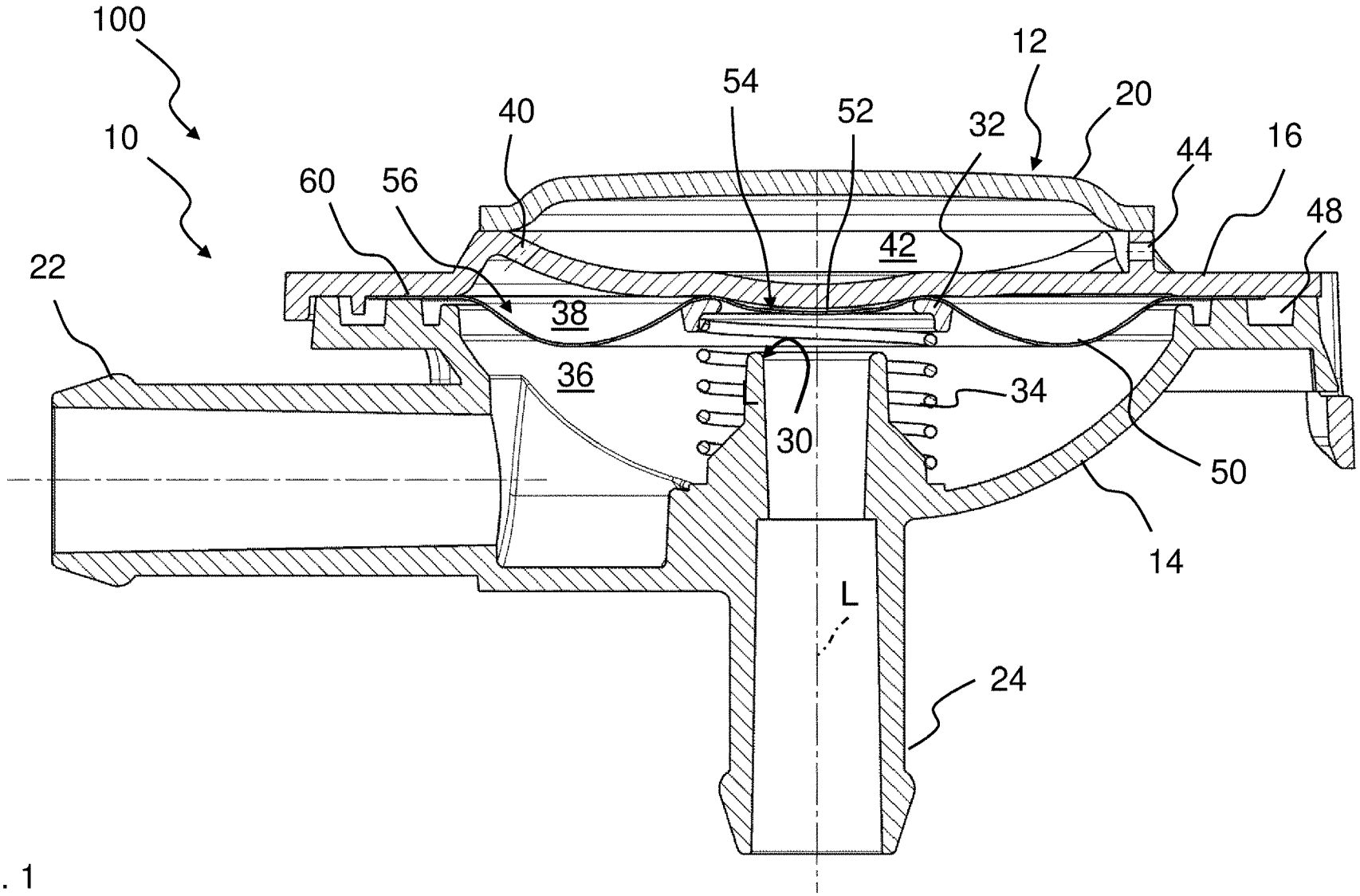
FIG. 1 shows a valve component with an areal switching element according to an embodiment of the invention in a section illustration.

In the Figures, same or same-type components are identified with same reference characters. The Figures show only examples and are not to be understood as limiting.

FIG. 1 shows a section illustration of a first embodiment of a valve component 100 according to the invention. This embodiment is beneficial when housing parts 14, 16 of the valve component 100 are connected to each other by laser welding. The valve component 100 comprises a unit 10 for regulating or controlling a fluid pressure as well as at least one expansion chamber 42. The unit 10 comprises a valve housing 12 which comprises a first housing part 14 and a second housing part 16. The first housing part 14 comprises an inlet 22, which is embodied like a socket in an exemplary fashion, and an outlet 24, which is embodied like a socket in an exemplary fashion, for a fluid. Between the two housing parts 14, 16, an areal switching element 50 is arranged which is serving for regulating, releasing or shutting off a flow of the fluid between the inlet 22 and the outlet 24. The switching element 50 separates the two chambers 36, 38 in the housing 12 from each other, wherein, in open switching position of the switching element 50, the inlet 20 and the outlet 24 are connectable through the bottom chamber 36.

The areal switching element 50 is in particular configured as a profiled film element and can be moved without switching plunger provided at the closure region 54. The switching element 50 comprises a flat clamping region 60 with which it is clamped between the rims of the first and second housing parts 14, 16. Centrally, a closure region 54 is provided which is arranged in a depression 52, pointing in the direction of the outlet channel toward the outlet 24 of the fluid. Substantially radially outside of the clamping region 60 of the switching element 50, a weld groove 48 is arranged in the first housing part 14.

Between the first chamber 36 and the second chamber 38, there is a pressure difference, wherein the second chamber 38 is in communication (not illustrated) with the surroundings, i.e., the atmospheric pressure. The switching element 50 can be moved with pressure differences of 1 mbar to 250 mbar, preferably of 1 mbar to 100 mbar, and serves for releasing or shutting off a flow of the fluid between the inlet 22 and the outlet 24. The inlet 22 of the unit 10 in the situation of use is in fluidic communication, for example, with the crankcase of an internal combustion engine while the outlet 24 is in fluidic communication with the intake manifold. The switching element 50 comprises a plate-shaped flat body with a corrugated bending region 56 surrounding the central closure region 54. When switching the switching element 50, the bending region 56 moves the closure region 54 relative to a valve seat 30 in axial direction L toward the valve seat 30 or away from the valve seat 30 by a low-expansion, in particular expansion-free, bending movement. The switching element 50 comprises for this purpose at least in the bending region 56 a thickness of at most 0.5 mm, preferably of at most 0.3 mm, particularly preferred of at most 0.2 mm. The diameter of the switching element 50 in this context is between 40 mm and 100 mm, preferably between 50 mm and 80 mm.

The bending region 56 extends in radial direction in a corrugated shape about the closure region 54 wherein a depression on a flat side corresponds to a projection at the other flat side of the switching element 50. The closure region 54 closes off the valve seat 30 fluid-tightly when it is resting against the valve seat 30. A spring element 34 is provided which is supported at the valve housing 12 and exerts a force on the closure region 54 of the switching element 50 and in this way compensates the atmospheric pressure in the upper second chamber 38. The spring element 34 in this context is supported by a ring 32 at the closure region 54.

The switching element 50 is preferably formed of fluorine and carbon comprising polymer film, for example PTFE. A beneficial diameter 64 of the switching element 50 is between 40 mm and 100 mm, preferably between 50 mm and 80 mm.

In the open state, as illustrated, the spring element 34 supported at the bottom housing part 14 of the housing 12 pushes the closure region 54 of the switching element 50 against the bottom side of the second housing part 16. In the closed position of the switching element 50, the spring element 34 is in a lower position in the Figure so that the switching element 50 with its closure region 54 is seated seal-tightly on the valve seat 30.

At least one first venting bore 40 extends from the upper chamber 38 into the expansion chamber 42 wherein the venting bore 40 is arranged in the second housing part 16, for example, in the housing cover. The expansion chamber 42 is arranged at the second housing part 16. The expansion chamber 42 can be comprised of several hollow spaces or formed by one hollow space. Optionally, the expansion chamber 42 can be filled with material in order to further improve possibly its acoustic effect.

In the illustrated embodiment, the second housing part 16 and a cover 20 provided at the second housing part 16 enclose the expansion chamber 42. For the aforementioned diameters of the switching element 50, a beneficial volume of the expansion chamber 40 amounts to between 10 ml and 100 ml. The cover 20 can be welded or glued to the second housing part 16 or can be connected by means of a screw connection, locking connection or the like.

The first venting bore 40 extends from the second chamber 38 through the second housing part 16 into the expansion chamber 42 at the second housing part 16. In the expansion chamber 42 at least one second venting bore 44 is arranged which is extending between the expansion chamber 42 and an outer region of the unit 10. The second venting bore 44 extends in the second housing part 16. Alternatively or additionally, a second venting bore 44 can be provided in the cover 20.

Figure 2:
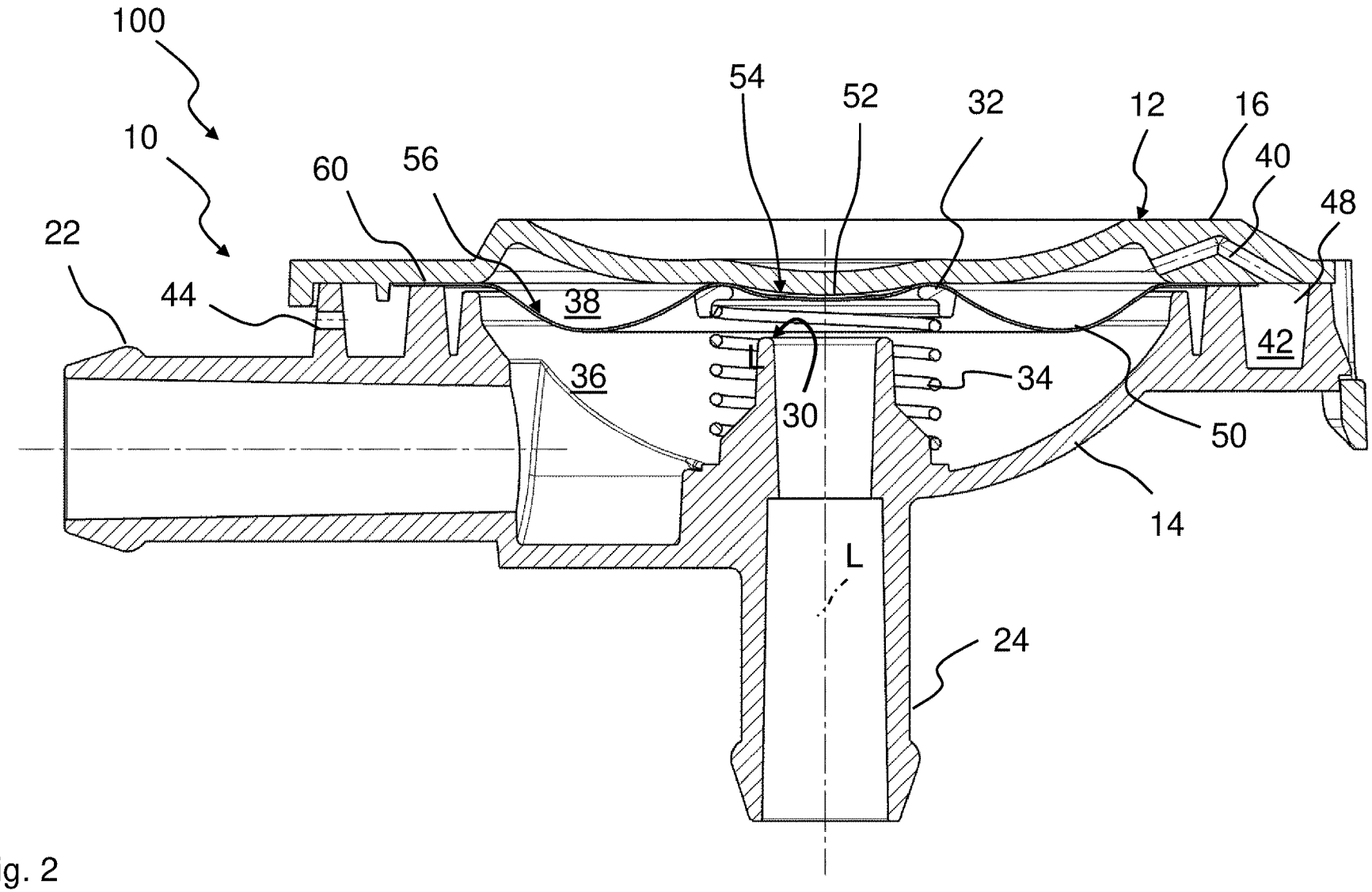
FIG. 2 shows a valve component with an areal switching element according to a further embodiment of the invention in a section illustration.

FIG. 2 shows a section illustration of an alternative embodiment of a valve component 100 according to the invention in which the at least one expansion chamber 42 is arranged in the first housing part 14. This embodiment is beneficial when housing parts 14, 16 are connected to each other, for example, by means of hot plate welding. The basic configuration of the valve component 100 matches substantially that of the embodiment in FIG. 1, in particular with regard to switching element 50, chambers 36, 38, inlet 22, outlet 24, housing parts 14, 16 of the housing 12, so that for avoiding unnecessary repetitions reference is being had to the figure description of FIG. 1.

The expansion chamber 42 in the embodiment of FIG. 2 is formed in a groove 48 in the housing 12 wherein the groove 48 is preferably arranged coaxially to the circumference of the switching element 50. The groove 48 is in particular a weld groove which receives material when welding the two housing parts 14, 16 together. In order to be able to receive the expansion chamber 42, the weld groove 48 is of a correspondingly larger embodiment.

At least one first venting bore 40 extends from the second housing part 16 to the first housing part 14, wherein air from the second chamber 38 can be guided into the groove 48 provided with the expansion chamber 42. The at least one second venting bore 40 extends in the first housing part 14 and penetrates the outer circumference of the weld groove 48.

Optionally, the embodiments of FIGS. 1 and 2 can also be present in combination.

While specific embodiments of the invention have been shown and described in detail to illustrate the inventive principles, it will be understood that the invention may be embodied otherwise without departing from such principles.

What is claimed is:

1. A valve component comprising:

at least one expansion chamber;

a unit configured to regulate or control a fluid pressure, the unit comprising:

a valve housing comprising a first housing part having a valve seat, and a second housing part;

the first housing part comprising an inlet and an outlet for a fluid;

a switching element arranged between the first housing part and the second housing part between the inlet and the outlet and configured to regulate, release or shut off a flow of the fluid, wherein the switching element is a profiled film of a fluorine and carbon comprising polymer material, a central portion of the profiled film forming a closure region of the profiled film which, when in a closed position, the closure region of the profiled film closes directly against the valve seat of the first housing part to close off the outlet, wherein the profiled film has a corrugated bending region surrounding the closure region, the corrugated bending region configured to bend during movement of the closure region of the profiled film from the closed position to an open position, wherein, when in the open position, the profiled film is spaced away from the valve seat, wherein the switching element separates a first chamber and a second chamber in the valve housing from each other;

wherein, in an open switching position of the switching element, the inlet and the outlet are connected to each other by the first chamber of the valve housing and wherein at least one first venting bore of the valve housing opens from the second chamber of the valve housing into the at least one expansion chamber.

2. The valve component according to claim 1, wherein the at least one expansion chamber is arranged at the second housing part.

3. The valve component according to claim 2, wherein the valve housing comprises a cover arranged on an outer side second housing part, wherein the outer side of the second housing part and the cover cooperate to together fully enclose the expansion chamber between the second housing part and the cover, wherein the at least one first venting bore has an opening at an inner side of a wall of the first housing part, the at least one first venting bore extending through the wall of the second housing part to open into the expansion chamber.

4. The valve component according to claim 2, wherein the at least one first venting bore extends from the second chamber through the second housing part into the at least one expansion chamber.

5. The valve component according to claim 1, wherein the unit comprises at least one second venting bore that extends from the at least one expansion chamber, through a wall of the valve housing and opens to an exterior environment at an exterior of the valve component.

6. The valve component according to claim 5, wherein the valve housing comprises a cover, wherein the at least one second venting bore extends in the second housing part and/or in the cover.

7. A valve component comprising:

at least one expansion chamber;

a unit configured to regulate or control a fluid pressure, the unit comprising:

a valve housing comprising a first housing part and a second housing part;

the first housing part comprising an inlet and an outlet for a fluid:

a switching element arranged between the first housing part and the second housing part between the inlet and the outlet and configured to regulate, release or shut off a flow of the fluid, wherein the switching element separates a first chamber and a second chamber in the valve housing from each other;

wherein, in an open switching position of the switching element, the inlet and the outlet are connected to each other by the first chamber of the valve housing and wherein at least one first venting bore of the valve housing opens from the second chamber of the valve housing into the at least one expansion chamber;

wherein the at least one expansion chamber is arranged in the first housing part.

8. The valve component according to claim 7, wherein the valve housing comprises a groove and the groove forms the at least one expansion chamber, wherein the groove is arranged coaxially to a circumference of the switching element.

9. The valve component according to claim 7, wherein the at least one first venting bore extends from the second housing part to the first housing part.

10. The valve component according to claim 7, wherein the unit comprises at least one second venting bore that extends between the at least one expansion chamber and an outer region of the unit, wherein the at least one second venting bore extends in the first housing part.

11. The valve component according to claim 1, wherein the second housing part and the first housing part are connected by a locking connection.

12. The valve component according to claim 1, wherein the polymer material is a fluorine and carbon comprising thermoplastic polymer material.

13. The valve component according to claim 12, wherein the thermoplastic polymer material is PTFE.

14. The valve component according to claim 7, wherein the first and second housing parts each comprise one of said at least one expansion chamber.

15. The valve component according to claim 1, configured for pressure regulation of an internal combustion engine.

16. The valve component according to claim 1, configured for pressure regulation of a crankcase of an internal combustion engine.

17. A cylinder head cover of an internal combustion engine, comprising a valve component according to claim 1 configured to regulate pressure of a crankcase of an internal combustion engine.

18. The valve component according to claim 7, wherein wherein the switching element is a profiled film of a fluorine and carbon comprising polymer material, a central portion of the profiled film forming a closure region of the profiled film which, when in a closed position, the closure region of the profiled film closes directly against a valve seat of the first housing part to close off the outlet.

* * * * *